US012735217B2

(12) United States Patent
Lei et al.

(10) Patent No.: US 12,735,217 B2
(45) Date of Patent: Sep. 15, 2026

(54) DROPPING DEVICE, SYSTEM AND FILLING METHOD

(71) Applicant: ABB SCHWEIZ AG, Baden (CH)

(72) Inventors: Haoteng Lei, Shanghai (CN); Leilei Wang, Jiangsu (CN); Yin Tian, Shanghai (CN)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 19/058,761

(22) Filed: Feb. 20, 2025

(65) Prior Publication Data

US 2025/0187770 A1 Jun. 12, 2025

Related U.S. Application Data

(63) Continuation of application No. PCT/CN2022/114300, filed on Aug. 23, 2022.

(51) Int. Cl.

| | |
|---|---|
| ***B65B 39/00*** | (2006.01) |
| ***B65B 5/04*** | (2006.01) |
| ***B65B 35/16*** | (2006.01) |
| ***B65B 57/14*** | (2006.01) |

(52) U.S. Cl.

CPC ..... *B65B 39/002* (2013.01); *B65B 5/04* (2013.01); *B65B 35/16* (2013.01); *B65B 57/14* (2013.01)

(58) Field of Classification Search

CPC ..... B65B 39/002; B65B 5/04; B65B 35/16; B65B 57/14; B65B 5/103; B65B 57/20; B65B 35/06; B65B 5/101; B65B 1/06; B65B 1/30; B65B 31/044; B65G 11/023; B65G 11/123; B65G 11/203; B65G 11/20; B65G 11/12; B65G 11/02

See application file for complete search history.

(56) References Cited

U.S. PATENT DOCUMENTS

| | | | |
|---|---|---|---|
| 6,182,842 B1 | 2/2001 | Dowling | |
| 2017/0029152 A1* | 2/2017 | Shim | B65B 57/20 |
| 2021/0284373 A1 | 9/2021 | Lebel et al. | |

FOREIGN PATENT DOCUMENTS

| | | | |
|---|---|---|---|
| CN | 203667537 U | | 6/2014 |
| CN | 104828456 A | | 8/2015 |
| JP | 2003126784 A | | 5/2003 |
| JP | 2009046129 A | | 3/2009 |
| JP | 2010189071 A | * | 9/2010 |

OTHER PUBLICATIONS

Machine Translation of JP-2010189071-A (Year: 2010).*

* cited by examiner

*Primary Examiner* — Veronica Martin

(74) *Attorney, Agent, or Firm* — Whitmyer IP Group LLC

(57) ABSTRACT

A dropping device, system and filling method. The dropping device includes a feeding port provided on an upper side of a dropping chute and configured to receive an object to be dropped; a first side wall extending from an edge of the feeding port in a direction deviated from a vertical direction by a first angle; and a second side wall disposed opposite to the first side wall and extending from an edge of the feeding port in a direction deviated from the vertical direction by a second angle. The second angle being greater than the first angle. A discharging port is provided on a lower side of the dropping device and configured to discharge the object.

14 Claims, 19 Drawing Sheets

DROPPING DEVICE, SYSTEM AND FILLING METHOD

CROSS-REFERENCE TO RELATED APPLICATIONS

This application claims priority to and is a continuation application of international patent application number PCT/CN2022/114300, filed on Aug. 23, 2022, which is herein incorporated by reference in its entirety.

FIELD

Embodiments of the present disclosure generally relate to the field of packaging apparatus, and more particularly, to a dropping device, system and filling method.

BACKGROUND

In packaging process of barreled or bowl packaged fast food, disposable fork is usually placed in barrel, bowl or cup for convenience of consumers. The most traditional way of placing the fork is to place it manually. A mechanical equipment is then applied to automatically complete the taking and placing of the fork. However, in the current market, manual operation has the defects of low efficiency and high labor cost, etc. and the mechanical equipment fork feeding is usually non-standard equipment. And thus it has the defects of single structure, poor compatibility, low flexibility and high maintenance cost, etc. There are also a few feeding cases with mechanical arm in the market. Its design usually directly adopts the combination of vibrator bowl and conveyor belt, which takes up a large space.

Thus, there is a need for a new approach for reducing the workload and improving the efficiency of dropping an object such as a fork, and improving the food safety.

SUMMARY

In view of the foregoing problems, various example embodiments of the present disclosure provide a dropping device, a system and a filling method.

In a first aspect, example embodiments of the present disclosure provide a dropping device for dropping an object into a container. The dropping device comprises: a feeding port provided on an upper side of the dropping chute and configured to receive an object; a first side wall extending from an edge of the feeding port in a direction deviated from a vertical direction by a first angle; and a second side wall disposed opposite to the first side wall and extending from an edge of the feeding port in a direction deviated from the vertical direction by a second angle, the second angle being greater than the first angle; and a discharging port provided on a lower side of the dropping chute and configured to discharge the object from the dropping device (200).

With such an arrangement, the posture of the object falling into the dropping device can be adjusted by the inclined second side wall to be suitable for dropping, and jamming and blocking of the object is prevented by the inclined first side wall. Thus the efficiency of dropping the object can be improved.

In some embodiments, the dropping device further comprises a movable plate mechanism coupled to the second side wall. The movable plate mechanism comprises a movable plate configured to form a portion of the second side wall close to the discharging port; and a first driving assembly provided on one side of the dropping device, configured to drive the movable plate to reciprocate a predetermined distance in an extending direction of the second side wall at a predetermined frequency.

With such an arrangement, in case that the object is hooked by the second side wall and thus object jamming occurs, the movable plate mechanism will eliminate the object jamming.

In some embodiments, the movable plate is of a long strip shape and comprises the same width as the second side wall and the movable plate is configured to overlap a fixed portion of the second side wall by a predetermined length.

With such an arrangement, the movable plate can move with respect to the fixed portion of the second side wall without creating a gap therebetween from which the object may be dropped out of the dropping chute.

In some embodiments, the dropping device further comprises: a funnel disposed below the discharging port and configured to receive the object discharged by the discharging port, the size and position of the funnel being configured to prevent the object from falling out of the funnel when the movable plate reciprocates.

With such an arrangement, the size and position of the funnel can ensure the object will not fall out of the funnel when the movable plate reciprocates.

In some embodiments, the first driving assembly comprises: a cylinder; a piston rod coupled to the cylinder and configured to move linearly under the action of the cylinder; a guide rail fixedly coupled to an outer wall of the dropping device; and a slider disposed on the guide rail and coupled to an end of the piston rod, the slider being configured to linearly move along the guide rail with the piston rod to drive the movable plate coupled to the slider.

With such an arrangement, the movable plate can move with the action of the cylinder, so as to prevent object jamming caused by object being hooked by the second side wall.

In some embodiments, the dropping chute further comprises: a third side wall coupled to the first side wall and the second side wall and extending in the vertical direction; wherein an upper end of the third side wall is provided with a bent portion to receive the object.

With such an arrangement, the bent portion can ensure the objected to be received and to fall into the dropping chute.

In some embodiments, the dropping chute further comprises: a fourth side wall opposite to the third side wall, the height of the fourth side wall is greater than the height of the third side wall.

With such an arrangement, since the height of the fourth side wall is greater than the height of the third side wall, the object will be prevented from falling out of the dropping chute over the fourth side wall.

In a second aspect of the present disclosure, example embodiments of the present disclosure provide a system. The system comprises: a dropping device according to any of the first aspect of the present disclosure; and a conveying device configured to convey an object from the dropping device; and a filling device. The filling device comprises a filling trough configured to receive an object from the conveying device, the filling trough comprises two movable bottom plates extending downward at a predetermined inclination angle with respect to a horizontal plane along a moving direction of the object; and the second driving assembly configured to move the bottom plates in response to receiving a signal indicating that the container reaches below the filling trough, so as to cause the object to fall into the container through an opening formed by the movement of the bottom plates away from each other.

With such an arrangement, the posture of the object falling into the dropping chute can be adjusted and jamming and blocking of the object can be prevented. Moreover, the inclined bottom plates of the filling trough can prevent a backward movement of the object due to rebound, so as to ensure the object can be positioned accurately on the proper position of the bottom plates, and fall out of the filling trough from the opening, whereby achieving a desired effect.

In some embodiments, the dropping chute further comprises: an insert plate adapted to be inserted into the cavity of the filling trough so as to block the object after entering the filling trough.

With such an arrangement, the volume of the cavity of the filling trough can be adjusted to adapt to different sizes of objects, such that the center of the object entering the filling trough is kept at a position substantially aligning with the center of an opening of the container.

In some embodiments, the second driving assembly comprises: a gripper comprising a body defining a chamber and a first piston and a second piston received in the chamber, the first piston and the second piston are configured to move in response to pressure increase and decrease in the chamber, and a first bottom plate of the bottom plates and a second bottom plate of the bottom plates are connected to the first piston and the second piston respectively via a link mechanism.

With such an arrangement, a first bottom plate of the bottom plates and a second bottom plate of the bottom plates can be driven quickly, whereby the object can be filled into the container in an efficient way.

In some embodiments, the filling device further comprises: a sensor located at the lower side of the filling trough and configured to sense the falling of the object to generate a corresponding signal.

With such an arrangement, the object can be monitored in a real time, and a corresponding signal such as an alerting signal can be generated if abnormal situation occurs.

In some embodiments, the system further comprises: a conveying line configured to convey the object; a camera configured to monitor the object entering a predetermined area of the conveying line and generate monitoring information; and a robot configured to grasp the object from the conveying line based on the monitoring information, and place the grasped object in each cell on the cell conveyor line.

With such an arrangement, the camera can monitor the object to obtain status information of the object, and notify the same to the robot. The robot can determine if the object can be grasped based on the status information. As a result, the robot cans action more efficiently.

In some embodiments, the robot includes a main robot and an auxiliary robot, the auxiliary robot being configured to grasp and place object missed by the main robot into a cell on the cell conveyor line.

With such an arrangement, the efficiency of grasping the object can be improved significantly.

In a third aspect of the present disclosure, example embodiments of the present disclosure provide a filling method. The method comprise: receiving an object to be filled; converting a falling posture of the object from a first posture to a second posture by using a dropping device; moving the object converted into the second posture into a filling trough, wherein the bottom plate of the filling trough is movable and extends downward at a predetermined inclination angle with respect to the horizontal plane along the moving direction of the object; and in response to receiving a signal indicating that the container reaches below the filling trough, moving the bottom plate away from each other to form an opening at the bottom side of the filling trough, so as to cause the object to fall into the container.

In this way, the object can be filled accurately into the container, whereby achieving a desired effect. Moreover, the efficiency of filling the object can be improved significantly.

In some embodiments, the side wall of the dropping chute comprises a movable plate, the movable plate constituting a portion of the second side wall of the dropping chute close to the discharging port, wherein converting the falling posture of the object from the first posture to the second posture by using the dropping chute comprises: moving the movable plate at a frequency greater than the frequency of dropping the object.

With such an arrangement, object jamming in the dropping chute can be eliminated due to the frequent movement of the movable plate.

It is to be understood that the Summary section is not intended to identify key or essential features of embodiments of the present disclosure, nor is it intended to be used to limit the scope of the present disclosure. Other features of the present disclosure will become easily comprehensible through the following description.

DESCRIPTION OF DRAWINGS

Through the following detailed descriptions with reference to the accompanying drawings, the above and other objectives, features and advantages of the example embodiments disclosed herein will become more comprehensible. In the drawings, several example embodiments disclosed herein will be illustrated in an example and in a non-limiting manner, wherein.

Throughout the drawings, the same or similar reference symbols are used to indicate the same or similar elements.

DETAILED DESCRIPTION OF EMBODIMENTS

Figure 1:
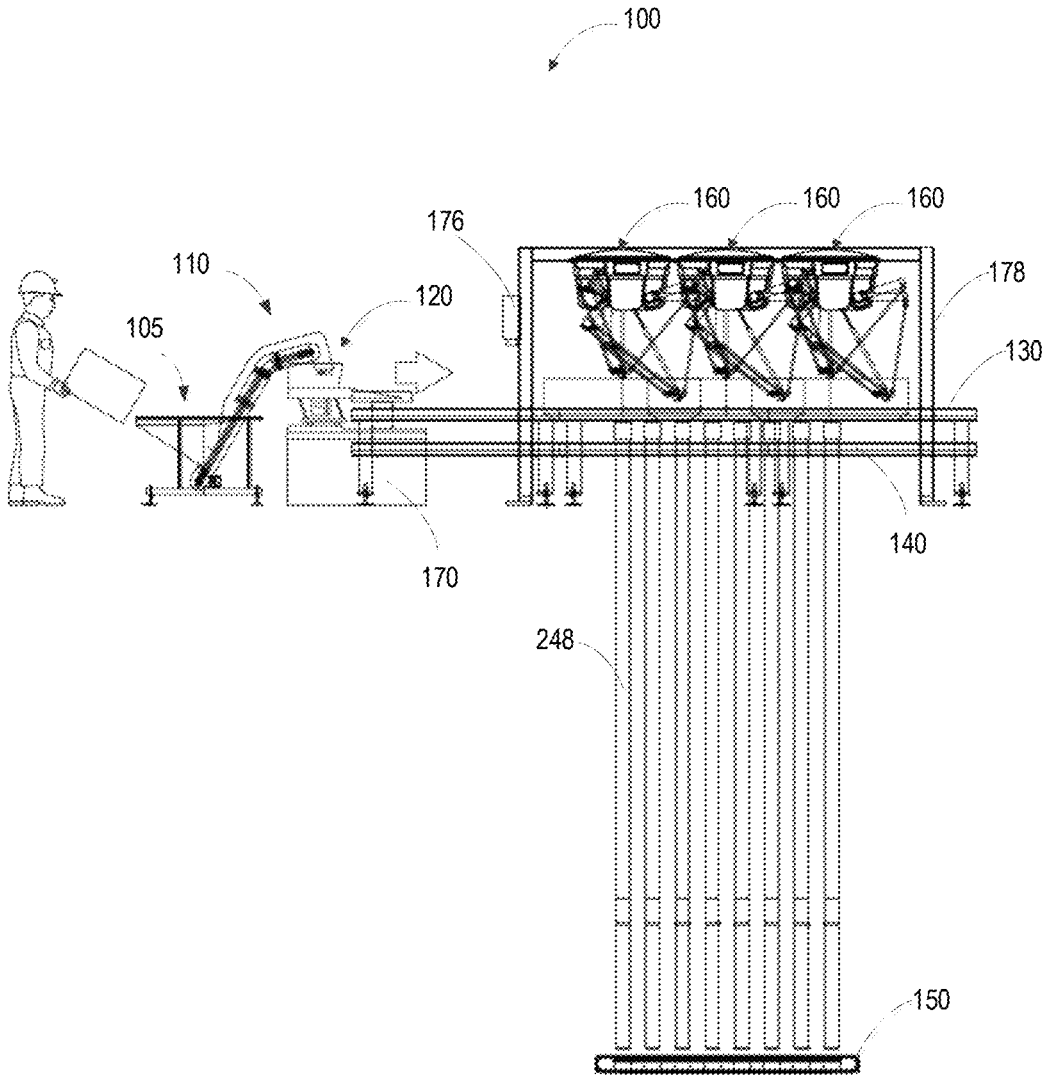
FIG. 1 is a schematic front view illustrating an system for filling an object into a container in accordance with an embodiment of the present disclosure.

Principles of the present disclosure will now be described with reference to several example embodiments shown in the drawings. Though example embodiments of the present disclosure are illustrated in the drawings, it is to be understood that the embodiments are described only to facilitate those skilled in the art in better understanding and thereby achieving the present disclosure, rather than to limit the scope of the disclosure in any manner.

The term "comprises" or "includes" and its variants are to be read as open terms that mean "includes, but is not limited to." The term "or" is to be read as "and/or" unless the context clearly indicates otherwise. The term "based on" is to be read as "based at least in part on." The term "being operable to" is to mean a function, an action, a motion or a state can be achieved by an operation induced by a user or an external mechanism. The term "one embodiment" and "an embodiment" are to be read as "at least one embodiment." The term "another embodiment" is to be read as "at least one other embodiment." The terms "first," "second," and the like may refer to different or same objects. Other definitions, explicit and implicit, may be included below. A definition of a term is consistent throughout the description unless the context clearly indicates otherwise.

As mentioned above, manual operation, traditional mechanical equipment feeding and mechanical arm feeding are defective.

Specifically, as to manual feeding, disposable bowls or cups containing food such as bread are transported to an operating station through a conveying line, and the operator manually takes the forks from containers in which the forks are stored in advance. Then, the operator puts the fork into the disposable bowl or cup which contains food. The efficiency of manual operation is low and labor cost is high. Moreover, missing fork during the process is inevitable.

Traditional mechanical equipment is usually non-standard equipment. Generally, its typical structure includes the following core components: belt conveying mechanism for fork transmission, vibration mechanism for fork feeding, etc. These components need to be customized according to the specific customer needs and material specifications, which causes the defects of single structure, poor compatibility, low flexibility and high maintenance cost. In addition, the efficiency of traditional mechanical equipment is low and the cost is high. Moreover, the equipment occupies a large space.

As to mechanical arm feeding, although the degree of automation is relatively high, its design usually directly adopts the combination of vibrator bowl (fork) and conveyor belt (noodle cup), which takes up a large space and the production efficiency is still needed to be improved.

In view of the forgoing, according to embodiments of the present disclosure, a dropping device for dropping an object into a container, system for filling an object into a container, and a method of filling an object into a container are provided in the present invention.

The dropping device comprises a feeding port, a first side wall, a second side and a discharging port. The feeding port is provided on an upper side of the dropping chute and is configured to receive an object to be dropped. The first side wall extends from an edge of the feeding port in a direction deviated from a vertical direction by a first angle. In other words, the first side wall extends from an edge of the feeding port in a direction deviated from a vertical line passing through the center of the feeding port. In this way, the object falling from the feeding port is unlikely to contact the inner wall of the first side wall. The second side wall is disposed opposite to the first side wall and extending from an edge of the feeding port in a direction deviated from the vertical direction by a second angle. In this way, the object falling from the feeding port is likely to contact the inner wall of the second side wall and change the direction of falling out of the dropping chute. That is, the second side wall is adapted to adjust the posture of the object falling into the dropping chute. The second angle is greater than the first angle. The discharging port is provided on a lower side of the dropping chute and is configured to discharge the object from the dropping device. With such an arrangement, the posture of the object falling into the dropping chute can be adjusted by the inclined second side wall to be suitable for dropping, and jamming and blocking of the object is prevented by the inclined first side wall. Thus the efficiency of dropping the object can be improved. The above idea may be implemented in various manners, as will be described in detail in the following paragraphs.

Figure 2:
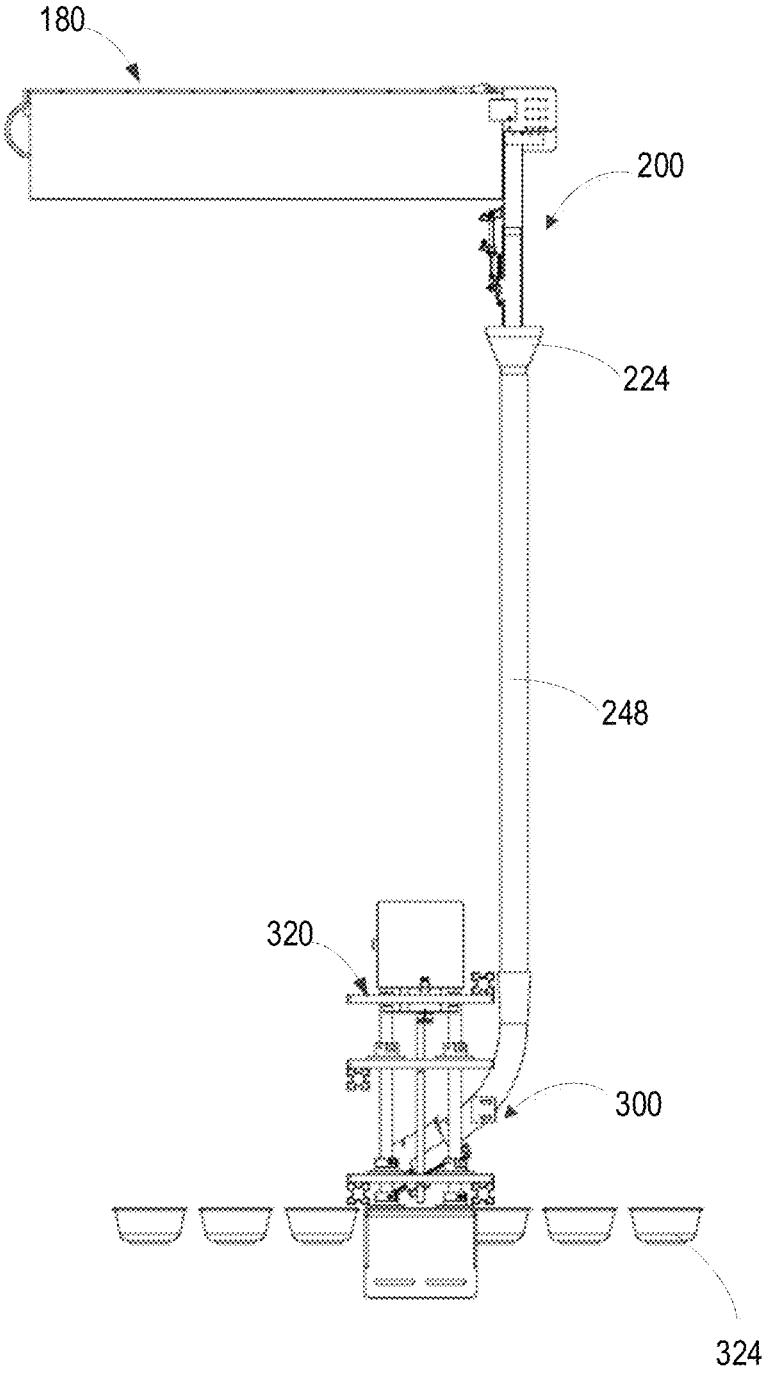
FIG. 2 is a schematic front view illustrating a system for filling an object into a container in accordance with an embodiment of the present disclosure.
Figure 3:
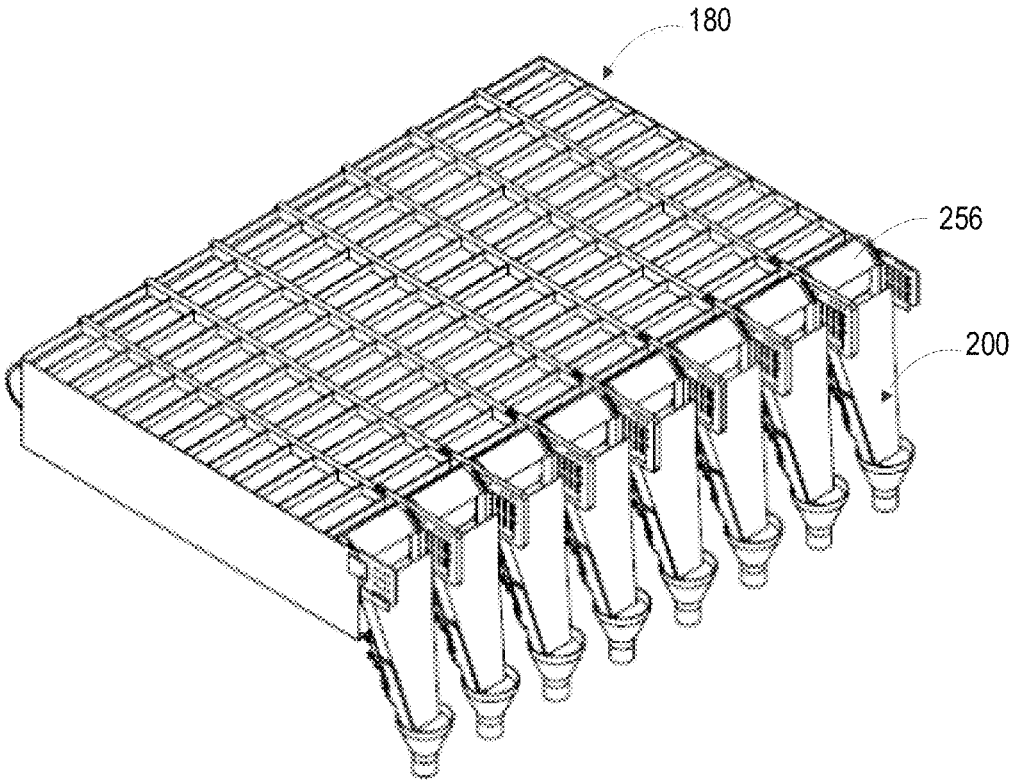
FIG. 3 is a perspective view of a cell conveyor line and the dropping device in accordance with an embodiment of the present disclosure.

Hereinafter, the principles of the present disclosure will be described in detail with reference to FIGS. 1-22. Referring to FIGS. 1 to 3 first, wherein FIG. 1 is a schematic front view illustrating an system 100 for filling an object into a container 324 in accordance with an embodiment of the present disclosure; FIG. 2 is a schematic front view illustrating an system for filling an object into a container 324 in accordance with an embodiment of the present disclosure; and FIG. 3 is a perspective view of a cell conveyor line 180 and the dropping device 200 in accordance with an embodiment of the present disclosure.

In some embodiments, as shown in FIG. 1, the system 100 generally includes an elevator 110, an object distribution mechanism 120, a base 170, a camera 176, robots 160, a support frame 178, a conveying line 130 and a return line 140. The object, such as fork, or knife, for example, may be manually poured into storage 105 by a worker. The elevator 110 provided in the cell conveyor line 180 may lift the object from the storage 105 to an object distribution mechanism 120 which is arranged adjacent to the elevator 110 and supported by a base 170.

The object distribution mechanism 120 may separate the objects into individual groups, for example, each of which may include one or two objects. The separated objects may be placed onto the conveying line 130 and delivered to the working area of the robot 160. The robot 160 includes arms, and the end of each arm is configured to move within a three-dimensional working area covering at least part of the area of the conveying line 130.

Vision recognition may be employed. For example, the camera 176 may be configured to monitor the object entering a predetermined area of the conveying line 130 and generate object grasping information. The object grasping information is sent from the camera 176 to the robot 160 which is supported by the support frame 178. The robot 160 can determine if the object can be grasped based on the object grasping information. As a result, the robot 160 can operate more efficiently. The robot 160 picks up an object and puts it into a cell. Only one object is placed in each cell. The object posture is transverse. There are totally eight cells in a row. Each time the cell conveyor line 180 is moving a step forward, eight objects fall at the same time. Eight objects enter a conveying device 248, which for example is a long pipeline, vertically through the dropping device 200 and fall into the downstairs filling device 300. After the noodle cups or bowls are transported in place by a cup or bowl conveyor line 150, the filling device 300 opens an opening to drop the fork into the cups or bowls. The cup or bowl conveyor line 150 moves forward and waits for a next filling. It is to be understood that the number of the cells are merely illustrative, and it may be other number different than eight.

As can be seen, three robots 160 are shown. It is to be understood that the scope of the present disclosure is not intended to be limited in this respect. Other configuration is also possible.

The cell conveyor line 180 is configured to convey the objects to the dropping device 200. The dropping device 200 is configured to drop the objects via the conveying device 248 to filling device 300. Finally, the objects are filled into container 324 below the filling device 300. The dropping device 200 and the filling device 300 are not shown in FIG. 1, and will be described in detail hereinafter.

As shown in FIG. 1, the fork has gone through the whole process from feeding, sorting, picking, dropping and filling. A prominent advantage of the invention is the automatic process flow of the mechanical arm, dropping mechanism, which may be located at a second floor, and filling mechanism, which may be located at a first floor.

The traditional way of fork feeding is that a vibrator bowl is used for sorting and feeding, with the fork head facing up and its tail facing down, to directly fall into a pipeline without the dropping device 200 described in this invention. The vibrator bowl makes the fork fall from the pipeline to the downstairs filling outlet, which is a horizontal object filling mode. From a practical point of view, it is not suitable for the mixed incoming object method described in this invention, which is easy to cause jamming, inaccurate delivery, etc. Mixed incoming object means that the head of fork may be face forward or backward.

Referring now to FIG. 2, the upper end of the dropping device 200 is coupled to the cell conveyor line 180 to receive the objects falling from the conveying line 180. The lower end of the dropping device 200 is coupled to the conveying device 248. The conveying device 248 is in turn coupled to a filling device 300. The conveying device 248 is for example a pipeline extending vertically from the lower end of the dropping device 200 to the upper end of the filling device 300. The conveying device 248 may be fixed by a fixing block 344 to for example a rack.

The filling device 300 is fixed by a fixed frame 320. A cup or bowl conveyor line is provided under the filling device, for example. Bowls may be conveyed on the bowl cup or bowl conveyor line and passed below the filling device. When the bowel is conveyed just below the filling device, the filling device 300 fills the object such as a fork via an opening of the filling device 300 into the bowel in which instant noodles is placed.

FIG. 3 shows a cell conveyor line 180 and the dropping device 200 in accordance with an embodiment of the present disclosure. As can be seen, the cell conveyor line 180 includes a plurality of cells arranged in rows and columns. In some embodiments, there are eight cells in each row. The cells are attached to a conveyor belt. The conveyor belt is of a closed loop structure, moving clockwise when viewed from the left in this figure. Each cell will be placed with an object such as a fork or a knife. When the cells reach to a position where the conveyor belt change the movement from horizontal direction to vertical direction, the fork falls and enters the dropping device 200.

A blocking plate 256 is provided before the inlet 204 of the dropping chute 202. When cell conveyor line 180 moves forward, the fork bypasses the arc surface and falls into the dropping chute 202 via a gap between the arc surface and the blocking plate 256 to prevent the fork from falling outside the inlet 204 or two forks from falling into the dropping chute 202 at the same time.

The dropping device 200 is configured to adjust the posture of the object falling into the dropping chute 202. The object will be dropped substantially in a vertical posture from the dropping chute 202 to the funnel 224 below the dropping chute 202. Eight dropping device 200 are illustrated in FIG. 3, it is to be understood that the scope of the present disclosure is not intended to be limited in this respect. Other number of dropping device 200 is also possible. The dropping device 200 will be described in detail with reference to FIGS. 4 to 6.

Figure 4:
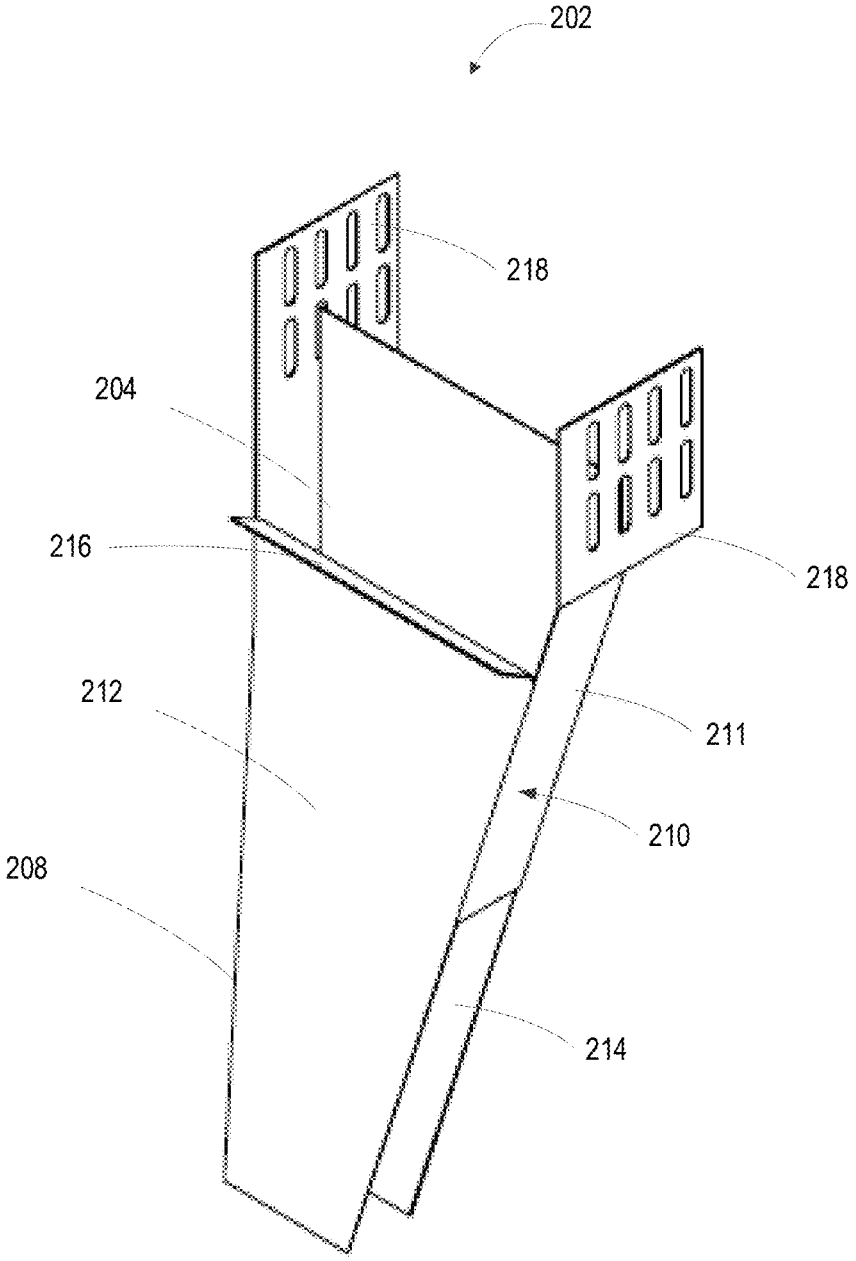
FIG. 4 is a perspective view illustrating an dropping chute for dropping an object into a container in accordance with an embodiment of the present disclosure.
Figure 5:
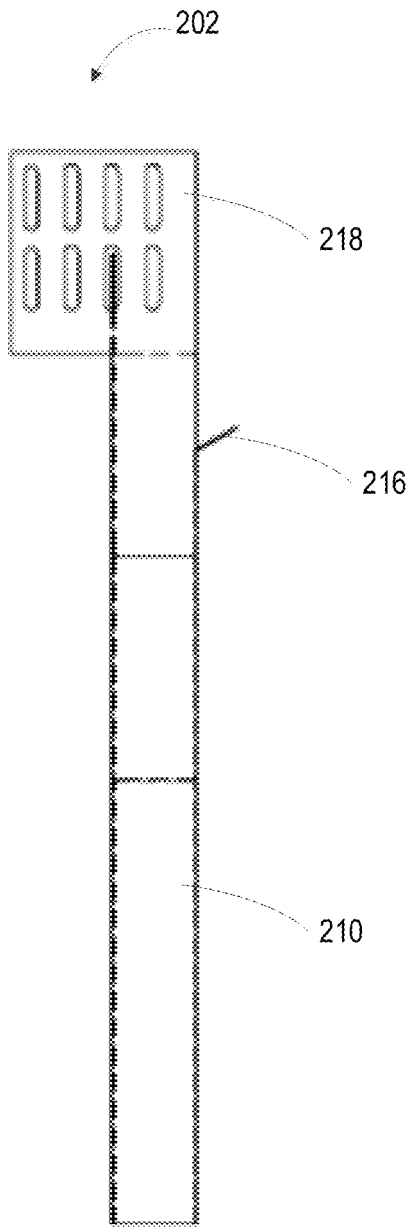
FIG. 5 is a schematic left view of the dropping chute as shown in FIG. 4.
Figure 6:
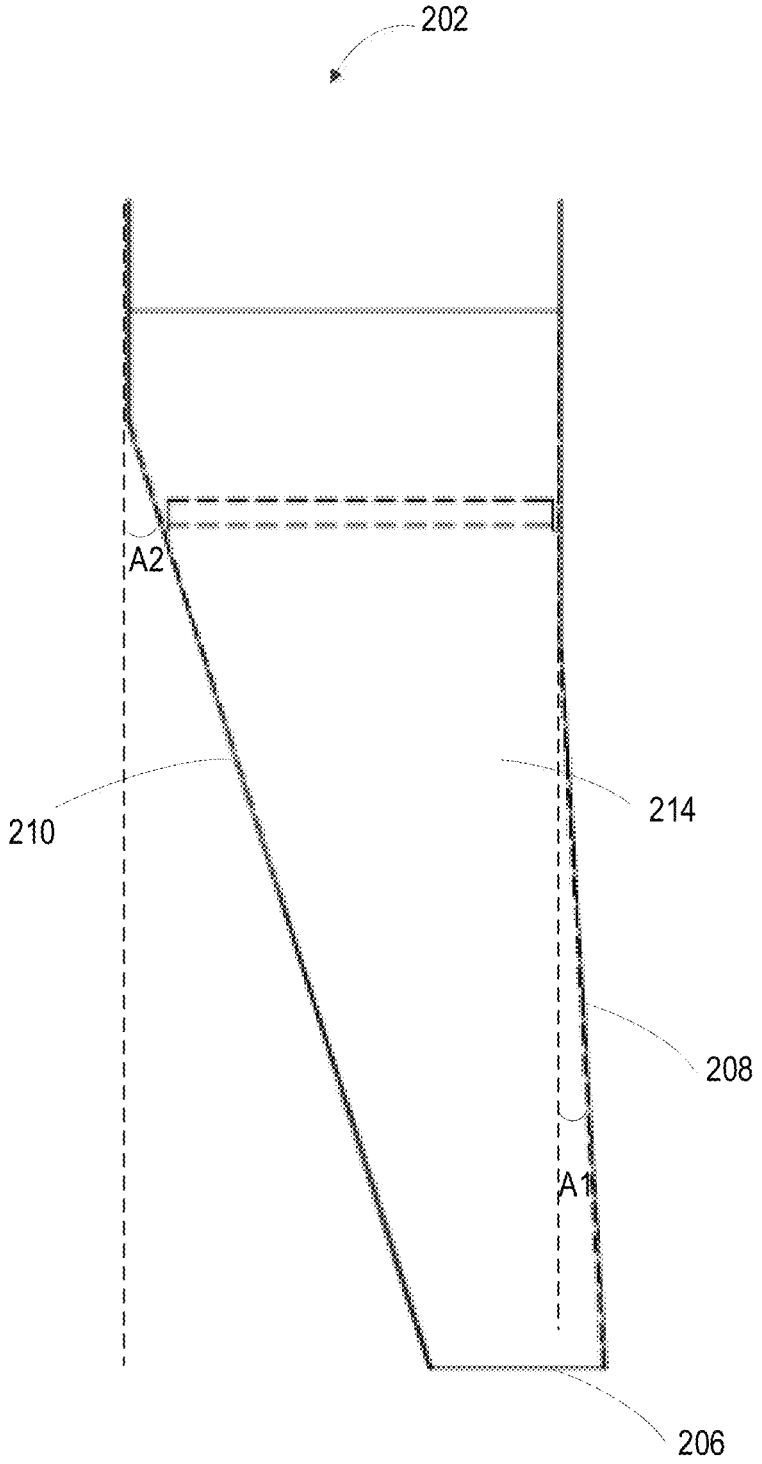
FIG. 6 is a schematic front view of the dropping chute as shown in FIG. 4.

FIG. 4 is a perspective view illustrating an dropping chute 202 for dropping an object into a container 324 in accordance with an embodiment of the present disclosure; FIG. 5 is a schematic left view of the dropping chute 202 as shown in FIG. 4; and FIG. 6 is a schematic front view of the dropping chute 202 as shown in FIG. 4.

In some embodiments, as shown in FIG. 4, the dropping device 200 may include a dropping chute 202. The dropping chute 202 is fixed to the cell conveyor line 180 by a fixing plate 218. The dropping chute 202 includes a feeding port 204, a first side wall 208, a second side wall 210 and a discharging port 206. The feeding port 204 is provided on an upper side of the dropping chute 202 and configured to receive an object to be dropped. The first side wall 208 extends from an edge of the feeding port 204 in a direction deviated from a vertical direction by a first angle A1, as shown in FIG. 6. Angle A1 may range from 5° to 20°. This angle makes first side wall 208 not likely hook the object such as the fork, whereby ensuring the fork not to be jammed in the dropping chute 202.

The second side wall 210 is disposed opposite to the first side wall 208 and extending from an edge of the feeding port 204 in a direction deviated from the vertical direction by a second angle A2, so as to adjust the posture of the object falling into the dropping chute 202, the second angle A2 is greater than the first angle A1. The discharging port 206 is provided on a lower side of the dropping chute 202 and configured to drop the object, at least some of which postures are adjusted.

In some embodiments, the dropping chute 202 further includes a third side wall 212 coupled to the first side wall 208 and the second side wall 210 and extending in the vertical direction. An upper end of the third side wall 212 is provided with a bent portion 216 to receive the object. With such an arrangement, the bent portion 216 can ensure the objected to be received and to fall into the dropping chute 202.

In some embodiments, the dropping chute 202 further comprises: a fourth side wall 214 opposite to the third side wall, the height of the fourth side wall 214 is greater than the height of the third side wall. With such an arrangement, since the height of the fourth side wall 214 is greater than the height of the third side wall, the object entering the dropping chute 202 along the bent portion 216 will be prevented from falling out of the dropping chute 202 over the fourth side wall 214.

In some embodiments, the dropping device 200 may further comprise a movable plate mechanism 220. The movable plate mechanism 220 is installed on the dropping chute 202. This will be further described with reference to FIGS. 7 to 14.

Figure 7:
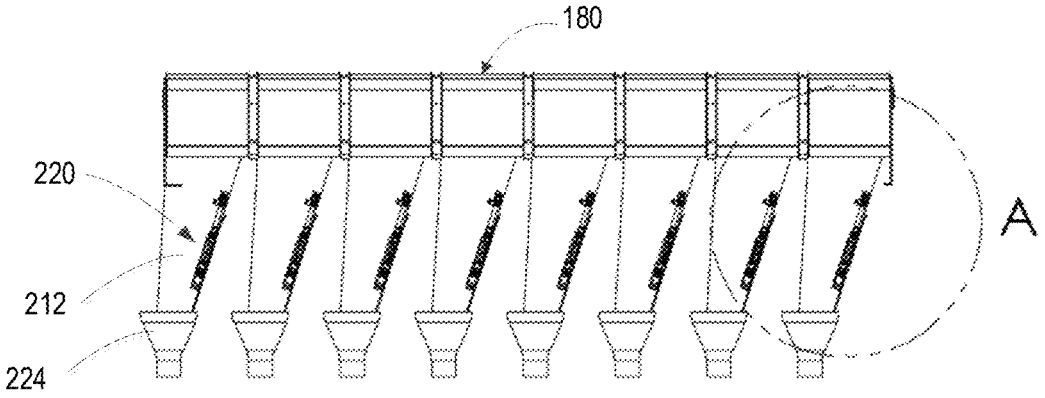
FIG. 7 is a schematic back view illustrating a cell conveyor line and the dropping device in accordance with an embodiment of the present disclosure.
Figure 8:
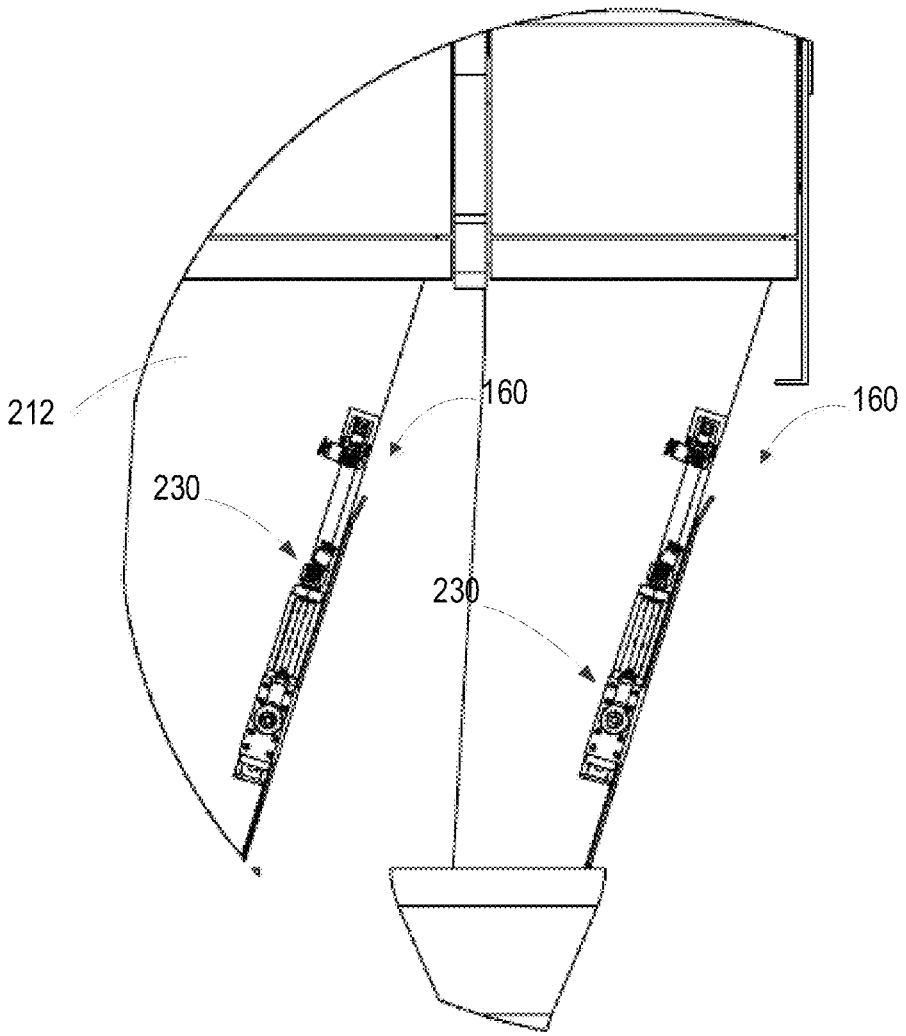
FIG. 8 is an enlarged view of the components indicated by a reference number A as shown in FIG. 7 in accordance with an embodiment of the present disclosure.

Referring to FIGS. 7 and 8 first, FIG. 7 is a schematic back view illustrating a cell conveyor line 180 and the dropping device 200 in accordance with an embodiment of the present disclosure; and FIG. 8 is an enlarged view of the components indicated by a reference number A as shown in FIG. 7 in accordance with an embodiment of the present disclosure.

As shown in FIG. 7, eight dropping device 200 are illustrated, each is equipped with a movable plate mechanism 220. As clearly shown in FIG. 8, the movable plate mechanism 220 is coupled to external wall of the dropping chute 202, for example, the second side wall. The detailed configuration of the movable plate mechanism 220 will be described with reference to FIGS. 10 to 14.

Figure 9:
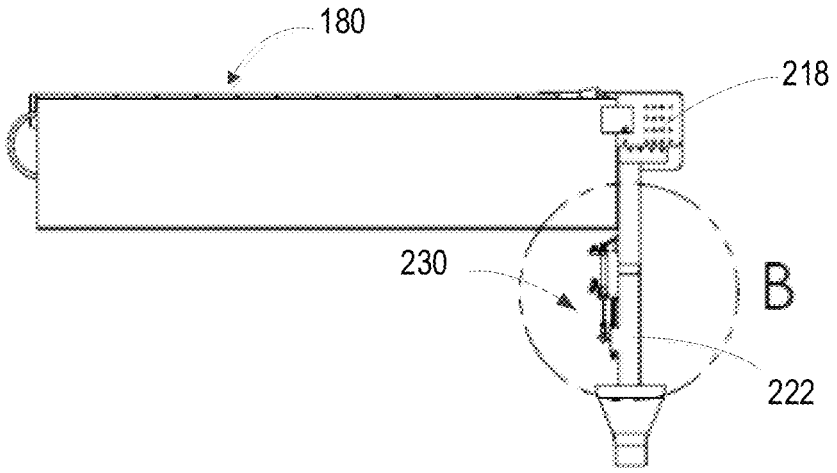
FIG. 9 is a schematic left view of a cell conveyor line and the dropping device in accordance with an embodiment of the present disclosure.
Figure 10:
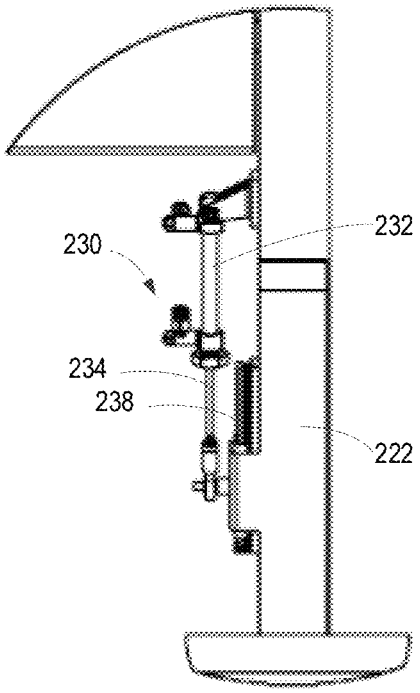
FIG. 10 is an enlarged view of the components indicated by a reference number B as shown in FIG. 9.

FIG. 9 is a schematic left view of a cell conveyor line 180 and the dropping device 200 in accordance with an embodiment of the present disclosure; and FIG. 10 is an enlarged view of the components indicated by a reference number B as shown in FIG. 9. As shown in FIGS. 9 and 10, the movable plate mechanism 220 includes a movable plate 222 and a first driving assembly 230. The movable plate 222 forms a portion of the second side wall 210 of the dropping chute 202 close to the discharging port 206.

The first driving assembly 230 is provided on a side of the dropping chute 202, and drives the movable plate 222 to reciprocate a predetermined distance in an extending direction of the second side wall 210 at a predetermined frequency. For example, the moving plate moves 2-3 times when cell conveyor line 180 is moving a step forward to prevent the object from being stuck in the dropping chute 202 and automatically remove the stuck object. With such an arrangement, in case that the object is hooked by the second side wall 210 and thus object jamming occurs, the movable plate mechanism 220 will eliminate the object jamming.

In some embodiments, the movable plate 222 is of a long strip shape and includes the same width as the second side wall 210, and the movable plate 222 overlaps a fixed portion 211 of the second side wall 210 by a predetermined length. With such an arrangement, the movable plate 222 can move with respect to the fixed portion 211 of the second side wall 210 without creating a gap therebetween from which the object may be dropped out of the dropping chute 202.

In some embodiments, the dropping device 200 further comprises: a funnel 224 disposed below the discharging port 206 and configured to receive the object dropping out of the discharging port 206, the size and position of the funnel 224 is configured to prevent the object from falling out of the funnel 224 when the movable plate 222 reciprocates. With such an arrangement, the size and position of the funnel 224 can ensure the object will not fall out of the funnel 224 when the movable plate 222 reciprocates.

In some embodiments, as shown in FIG. 10, the first driving assembly 230 includes a cylinder, a piston rod 234, a guide rail 238, and a slider. The piston rod 234 is coupled to the cylinder 232 and configured to move linearly under the action of the cylinder. The guide rail 238 is fixedly coupled to an outer wall of the dropping chute 202. The slider 236 (refer to FIG. 12) is disposed on the guide rail 238 and coupled to an end of the piston rod 234. The slider is configured to linearly move along the guide rail 238 with the piston rod 234 to drive the movable plate 222 coupled to the slider 236. With such an arrangement, the movable plate 222 can move with the action of the cylinder 232, so as to prevent jamming caused by object being hooked by the second side wall 210.

Figure 11:
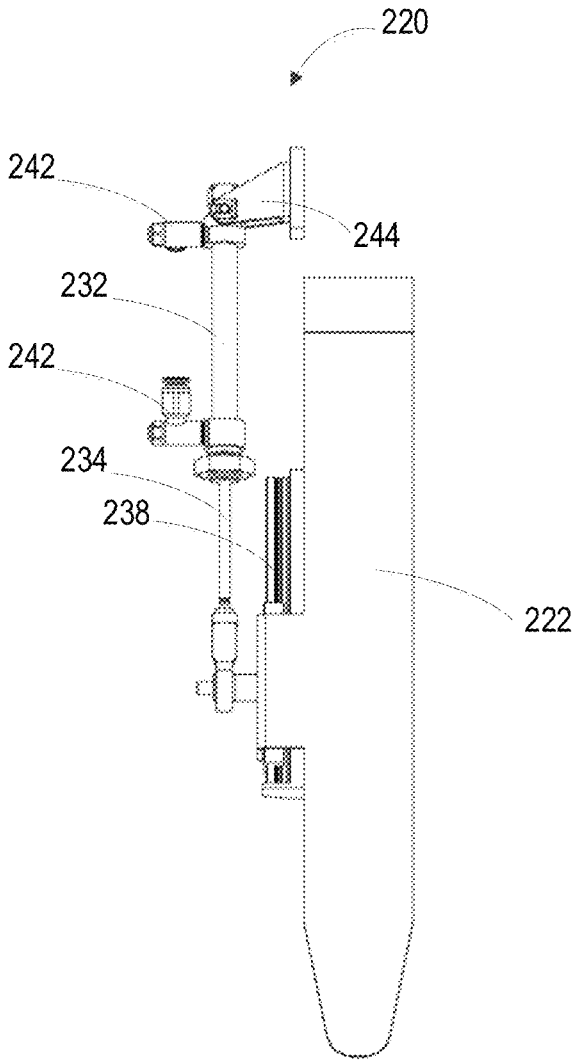
FIG. 11 is a schematic left view illustrating an movable plate mechanism in accordance with an embodiment of the present disclosure.
Figure 12:
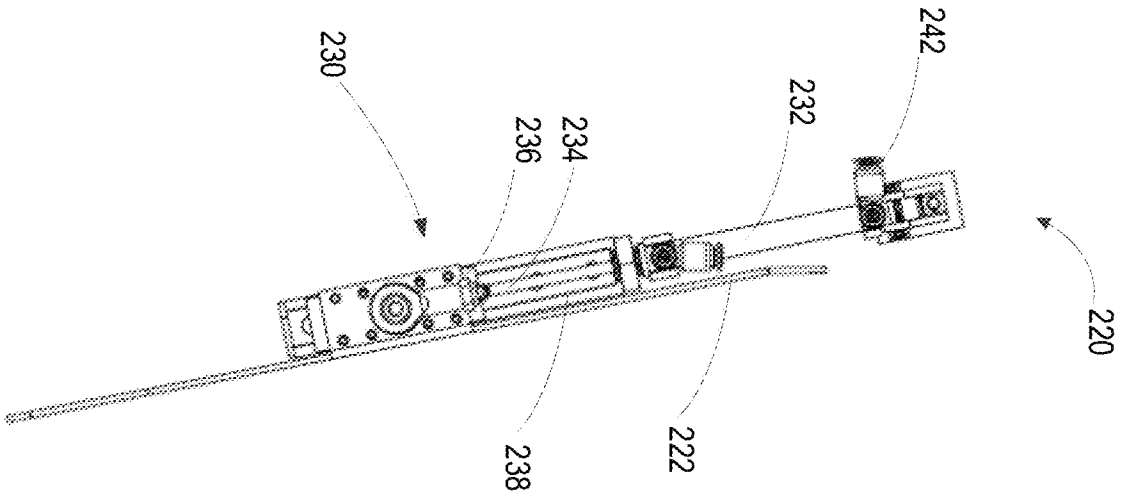
FIG. 12 is a schematic back view of the movable plate mechanism as shown in FIG. 11.
Figure 13:
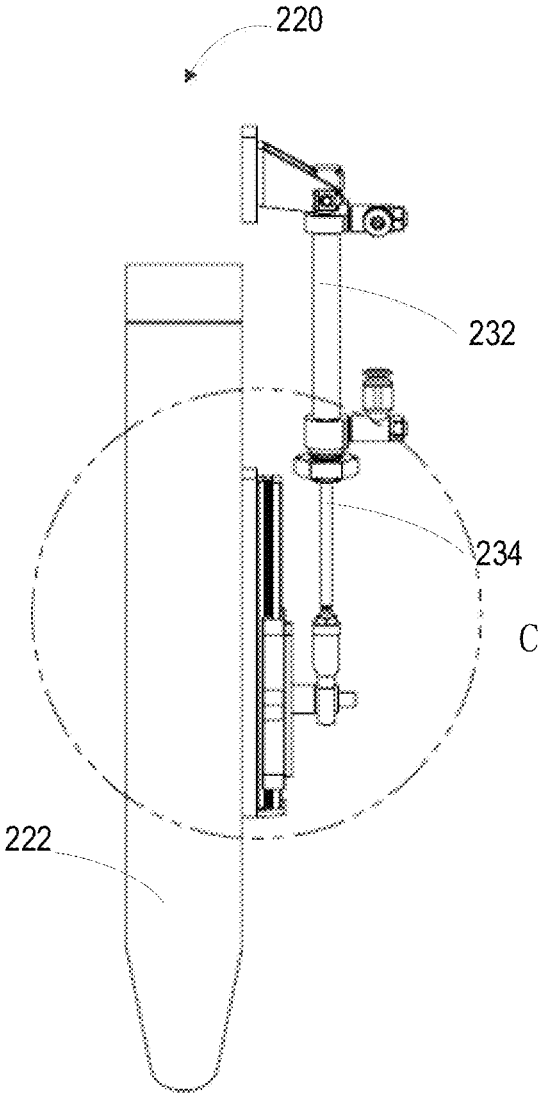
FIG. 13 is a schematic back view of the movable plate mechanism as shown in FIG. 11.
Figure 14:
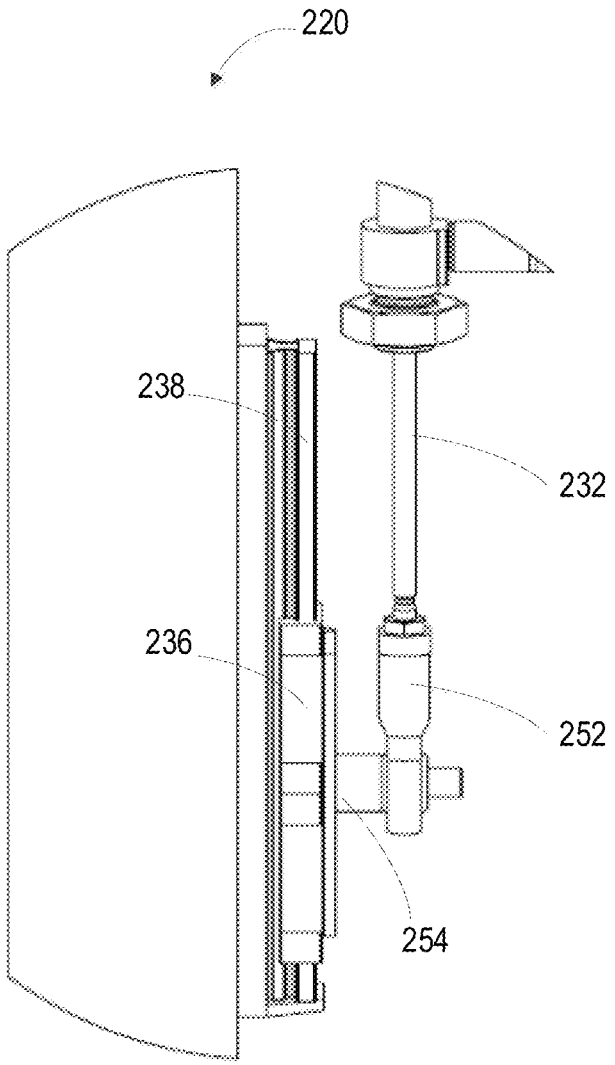
FIG. 14 is an enlarged view of the components indicated by a reference number C as shown in FIG. 13.

The movable plate mechanism 220 will be further described with reference to FIGS. 11 to 14. FIG. 11 is a schematic left view illustrating an movable plate mechanism 220 in accordance with an embodiment of the present disclosure; FIG. 12 is a schematic back view of the movable plate mechanism 220 as shown in FIG. 11; FIG. 13 is a schematic back view of the movable plate mechanism 220 as shown in FIG. 11, and FIG. 14 is an enlarged view of the components indicated by a reference number C as shown in FIG. 13.

As mentioned above, the movable plate mechanism 220 may include a movable plate 222 and a first driving assembly 230. The movable plate 222 forms a portion of the second side wall 210 of the dropping chute 202 close to the discharging port 206. The cylinder 232 is fixed on an external wall for example the third side wall 212 of the dropping chute 202 by a mounting base 244. Throttle valve 242 is configured to adjust the pressure in the cylinder.

The piston rod 234 is coupled to the cylinder 232 and configured to move linearly under the action of the cylinder 232. An end of the piston rod 234 is coupled to a floating joint 252, and the floating joint 252 in turn is coupled to a movable block 254, which is in turn coupled to the slider 236. The guide rail 238 is fixedly coupled to an outer wall of the dropping chute 202. The slider 236 is disposed on the guide rail 238 and coupled to an end of the piston rod 234. The slider 236 is configured to linearly move along the guide rail 238 with the piston rod 234 to drive the movable plate 222 coupled to the slider 236.

FIGS. 11 to 14 illustrate the configuration of the movable plate mechanism 220, it is to be understood that the scope of the present disclosure is not intended to be limited in this respect. Other configuration is also possible.

Figure 15:
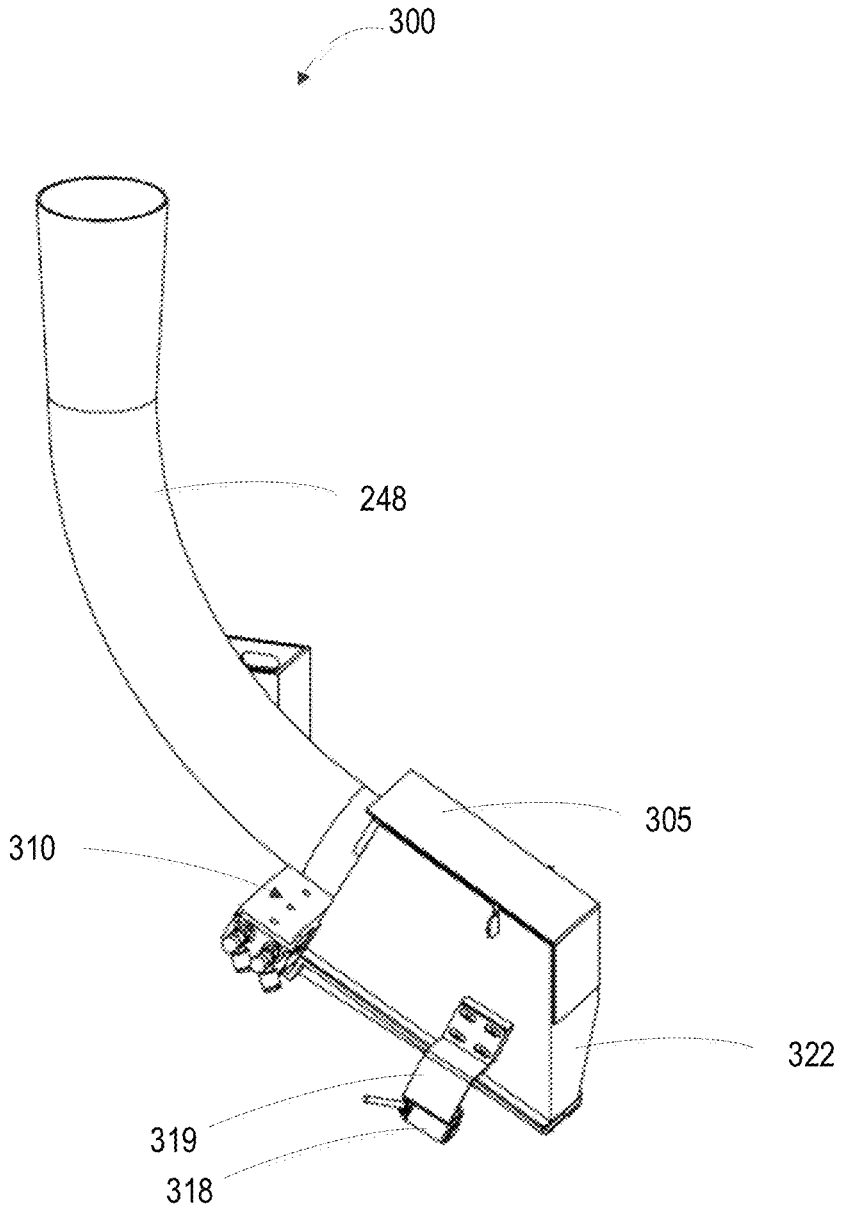
FIG. 15 is a perspective view illustrating an filling device in accordance with an embodiment of the present disclosure.
Figure 16:
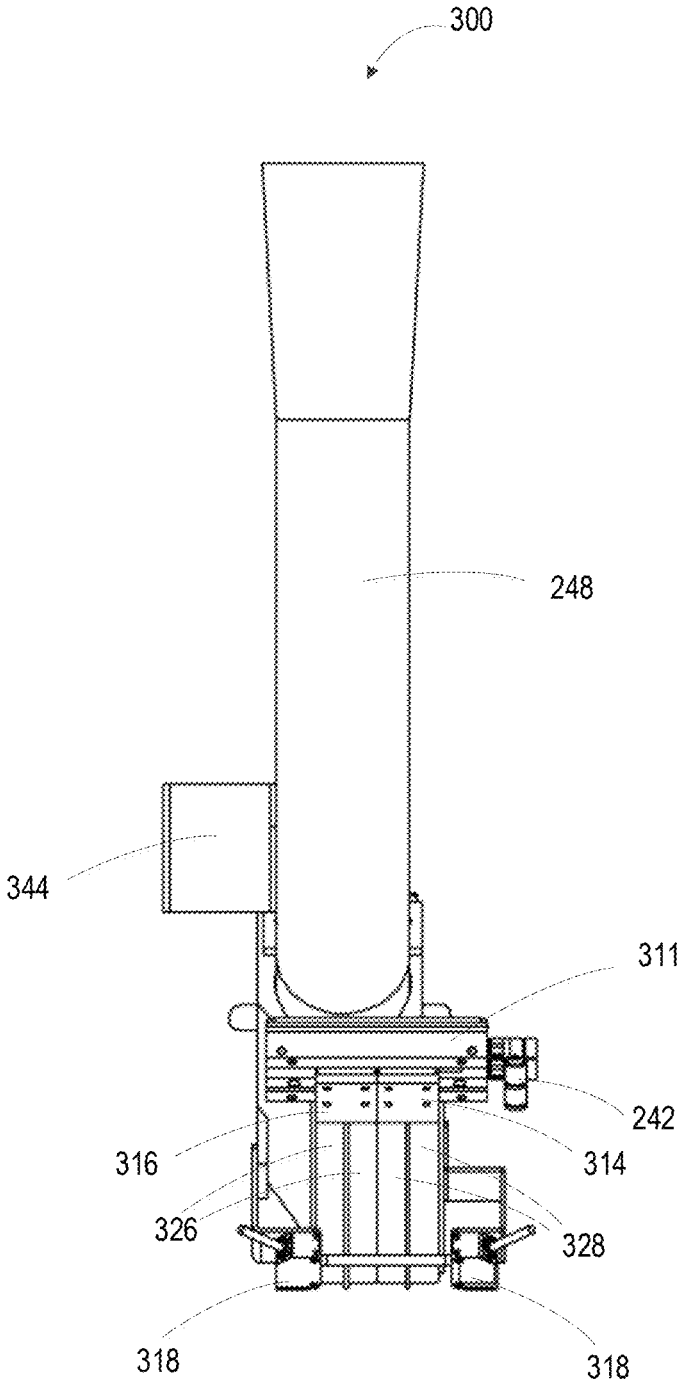
FIG. 16 is a schematic back view of the filling device as shown in FIG. 15.
Figure 17:
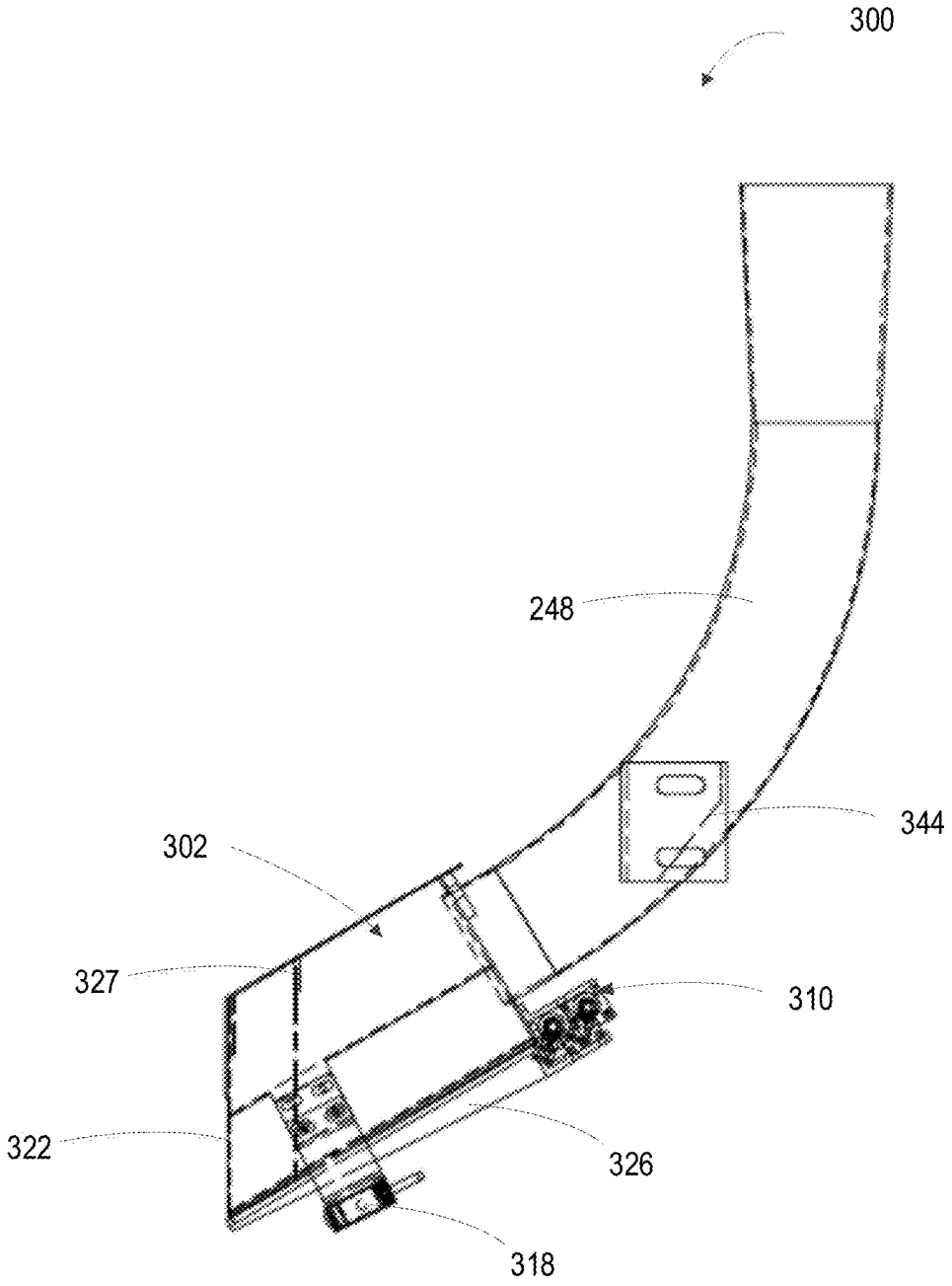
FIG. 17 is a schematic right view of the filling device as shown in FIG. 15.

The filling device 300 will be described below with reference to FIGS. 15 to 22. Referring FIGS. 15 to 17 first, wherein FIG. 15 is a perspective view illustrating a filling device 300 in accordance with an embodiment of the present disclosure; FIG. 16 is a schematic back view of the filling device 300 as shown in FIG. 15; and FIG. 17 is a schematic right view of the filling device 300 as shown in FIG. 15.

In some embodiments, as shown in FIG. 15, a conveying device 248 is coupled to the filling device. The conveying device 248 may be a pipeline. The pipeline is configured to convey the object from the dropping device 200. The filling device 300 includes a filling trough 302. The filling trough 302 is configured to receive an object from the conveying device 248. The filling trough 302 includes two movable bottom plates, i.e., a first bottom plate 326 and a second bottom plate 328, extending downward at a predetermined inclination angle with respect to a horizontal plane along a moving direction of the object. That is, the front end of movable bottom plates is lower than the rear end of the movable bottom plates. With such an arrangement, the inclined bottom plates of the filling trough 302 can prevent a backward movement of the object due to rebound by the front plate 322. The reason is that because the bottom plate is inclined, the fork falling on the bottom plate will not move a large distance even if it rebounds. The fork from the pipeline stops on the inclined bottom plate of the filling mechanism.

The second driving assembly 310 is configured to move the bottom plates in response to receiving a signal indicating that the container 324 reaches below the filling trough 302, so as to cause the object to fall into the container 324 through an opening formed by the movement of the first bottom plate 326 and the second bottom plate 328 away from each other. With such an arrangement, the posture of the object falling into the dropping chute 202 can be adjusted and jamming and blocking of the object can be prevented. Moreover, the inclined bottom plates of the filling trough 302 can prevent a backward movement of the object due to rebound, so as to ensure the object can be positioned accurately on the proper position of the bottom plates, and fall out of the filling trough 302 from the opening, whereby achieving a desired effect.

In some embodiments, the filling device 300 further comprises: a sensor 318 located at the lower side of the filling trough 302 and configured to sense the falling of the object to generate a corresponding signal. The sensor 318 may be fixed to the filling trough 302 through a sensor rack 319.

With such an arrangement, the object can be monitored in a real time, and a corresponding signal such as an alerting signal can be generated if abnormal situation occurs.

Figure 18:
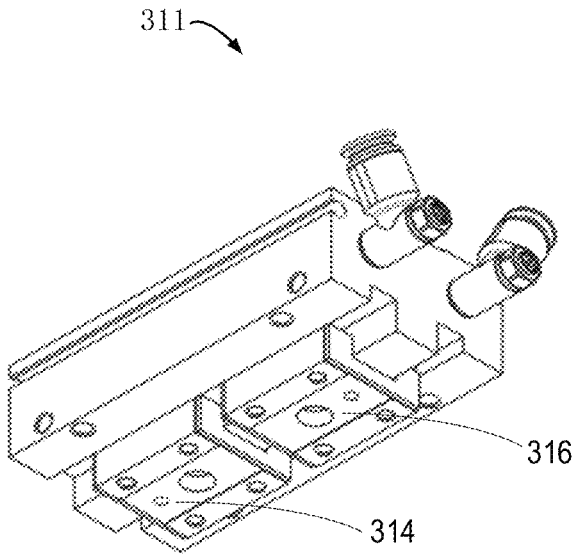
FIG. 18 is a perspective view of a gripper in accordance with an embodiment of the present disclosure.

In some embodiments, the second driving assembly 310 includes a gripper 311. The gripper 311 will be described with reference to FIG. 18. FIG. 18 is a perspective view of a gripper 311 in accordance with an embodiment of the present disclosure. The gripper 311 includes a body defining a chamber and a first piston 314 and a second piston 316 received in the chamber. The first piston 314 and the second piston 316 are configured to move in response to pressure increase and decrease in the chamber, and a first bottom plate 326 of the bottom plates and a second bottom plate 328 of the bottom plates are connected to the first piston 314 and the second piston 316 respectively via a link mechanism. With such an arrangement, the first bottom plate 326 and the second bottom plate 328 can be driven quickly, whereby the object can be filled into the container 324 in an efficient way.

In some embodiments, the dropping chute 202 further includes an insert plate. The insert plate 327 is adapted to be inserted into the cavity of the dropping chute 202 so as to block the object after entering the filling trough 302. With such an arrangement, the volume of the cavity of the filling trough 302 can be adjusted to adapt to different sizes of objects, such that the center of the object entering the filling trough 302 is kept at a position substantially aligning with the center of an opening of the container 324.

Figure 19:
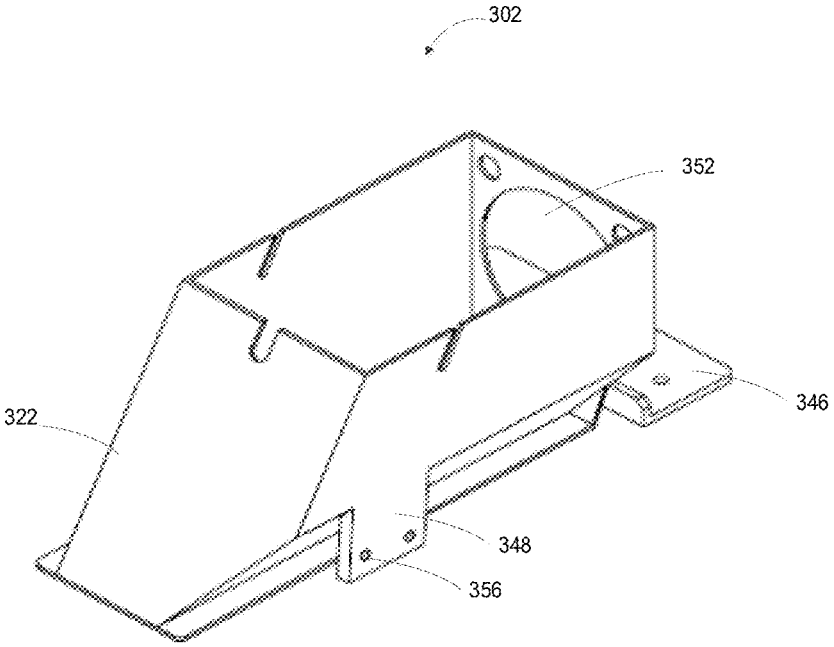
FIG. 19 is a perspective view of a filling trough in accordance with an embodiment of the present disclosure.
Figure 20:
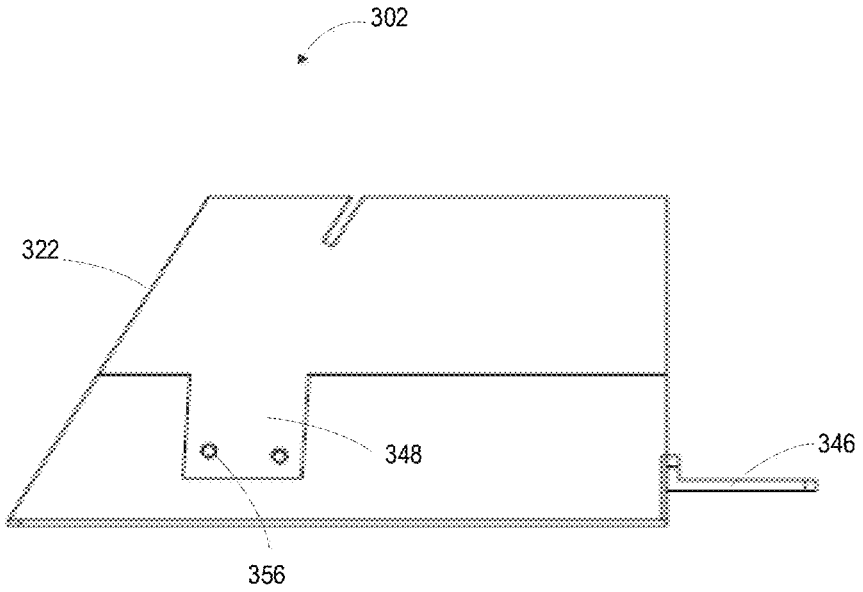
FIG. 20 is a right view of the filling trough as shown in FIG. 19.
Figure 21:
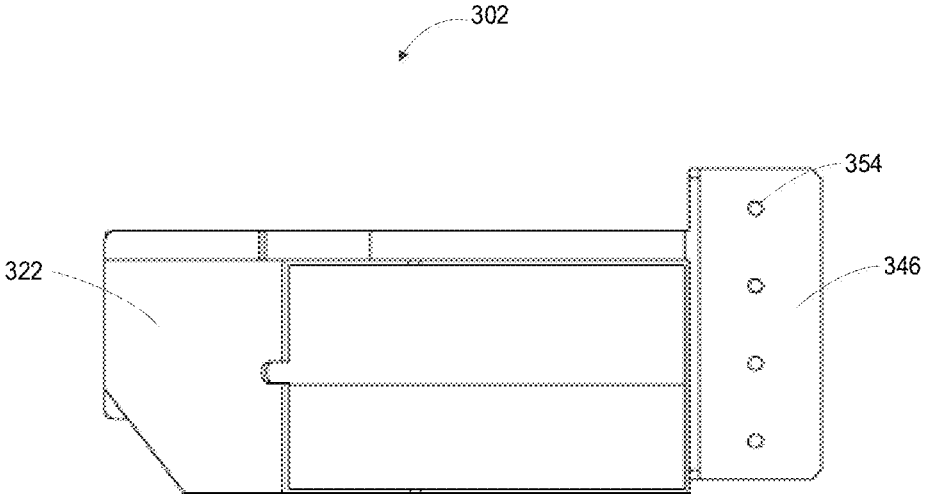
FIG. 21 is a top view of the filling trough as shown in FIG. 19.
Figure 22:
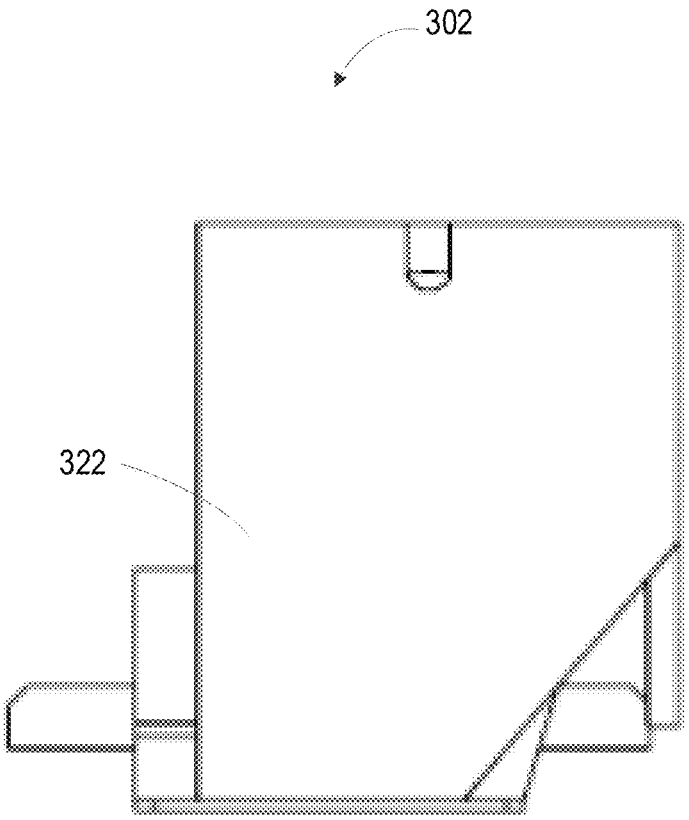
FIG. 22 is a front view of the filling trough as shown in FIG. 19.

The filling trough 302 will be further described with reference to FIGS. 19 to 22. FIG. 19 is a perspective view of a filling trough 302 in accordance with an embodiment of the present disclosure; FIG. 20 is a right view of the filling trough 302 as shown in FIG. 19; FIG. 21 is a top view of the filling trough 302 as shown in FIG. 19; and FIG. 22 is a front view of the filling trough 302 as shown in FIG. 19.

As shown in FIGS. 19 to 21, the filling trough 302 includes an inlet 352, from which the object enters the filling trough 302. A mounting plate 346 is coupled to the filling trough 302. The second driving component 310 may be mounted on the mounting plate 346 via a threaded hole 354. The front plate 322 of the filling trough 302 is inclined by a predetermined angle, such that when the filling trough 302 is fixed, the front plate 322 is substantially vertical to the horizontal plane.

As shown in FIG. 20, a sensor 318 mounting plate 348 is provided on a side of the filling trough 302. A sensor 318 may be mounted on the sensor 318 mounting plate 348 via a hole 356.

A cover plate 305 is provided on the top of the filling trough 302, and is configured to prevent the fork from falling out of the filling trough 302.

In some embodiments, a filling method is provided. The method includes: receiving an object to be filled into a container; converting a falling posture of the object from a first posture to a second posture by using a dropping device 200; moving the object converted into the second posture into a filling trough 302, wherein the bottom plate of the filling trough 302 is movable and extends downward at a predetermined inclination angle with respect to the horizontal plane along the moving direction of the object; and in response to receiving a signal indicating that the container 324 reaches below the filling trough 302, moving the bottom plate away from each other to form an opening at the bottom side of the filling trough 302, so as to cause the object to fall into the container 324. In this way, the object can be filled accurately into the container 324, whereby achieving a desired effect. Moreover, the efficiency of filling the object can be improved significantly.

In some embodiments, the dropping chute 202 comprises a movable plate, the movable plate forms a portion of the second side wall 210 of the dropping chute 202 close to a discharging port 206, wherein converting the falling posture of the object from the first posture to the second posture by using the dropping chute 202 comprises moving the movable plate 222 at a frequency greater than the frequency of dropping the object. With such an arrangement, object jamming in the dropping chute 202 can be eliminated due to the frequent movement of the movable plate.

In some embodiments, the feeding mechanism of the invention adopts the top-down pipe mechanism with vertical fork free fall, which not only solves the problems mentioned above, but also solves the problems of material (also referred to as object, such as fork or knife) jamming and blocking of the traditional vibration mechanism, as well as the problem that object may pop up or cannot be completely thrown into the cup or bowl.

The fork dropping and filling mechanism designed by the invention has unique advantages. At present, there is no similar product in the market. As a new application field, the invention completely solves the disadvantages of the traditional fork feeding process and has the following advantages:

Compared with manual operation, the combination of robot 160 and automatic feeding mechanism, for example, dropping device 200 and filling device 300, has incomparable advantages in production efficiency, environmental health guarantee, safety guarantee, cost, feeding reliability, stability and success rate.

The automatic feeding mechanism has strong adaptability. For example, the fork of instant noodles is divided into straight fork and folding fork, with more than three specifications. The system of the present disclosure fully adapts to each specification. When changing the product specification, there is no need to make any adjustment in hardware, and the structure is compact, which makes it easy to operate when changing the production line. Therefore, the production efficiency, reliability and accuracy of feeding are greatly improved.

By contrast, the traditional vibration mechanism adaptability to objects is relatively single, resulting in high production and maintenance costs.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A dropping device comprising:

a feeding port provided on an upper side of the dropping device and configured to receive an object;

a first side wall extending from an edge of the feeding port in a direction deviated from a vertical direction by a first angle;

a second side wall disposed opposite to the first side wall and extending from the edge of the feeding port in a direction deviated from the vertical direction by a second angle, the second angle being greater than the first angle; and a discharging port provided on a lower side of the dropping device and configured to discharge the object from the dropping device.

2. The dropping device according to claim 1, further comprising:

a movable plate mechanism coupled to the second side wall and comprising:

a movable plate configured to form a portion of the second side wall close to the discharging port; and a first driving assembly provided on a side of the dropping device and configured to drive the movable plate to reciprocate a predetermined distance in an extending direction of the second side wall at a predetermined frequency.

3. The dropping device according to claim 2, wherein the movable plate is of a long strip shape and comprises a width that is same as the second side wall, the movable plate being configured to overlap a fixed portion of the second side wall by a predetermined length.

4. The dropping device according to claim 3, further comprising:

a funnel disposed below the discharging port and configured to receive the object discharged by the discharging port, a size and position of the funnel being configured to prevent the object from falling out of the funnel when the movable plate reciprocates.

5. The dropping device according to claim 2, wherein the first driving assembly comprises:

a cylinder;

a piston rod coupled to the cylinder and configured to move linearly under an action of the cylinder;

a guide rail fixedly coupled to an outer wall of the dropping device; and a slider disposed on the guide rail and coupled to an end of the piston rod, the slider being configured to linearly move along the guide rail with the piston rod to drive the movable plate coupled to the slider.

6. The dropping device according to claim 1, further comprising:

a third side wall coupled to the first side wall and the second side wall and extending in the vertical direction;

wherein an upper end of the third side wall is provided with a bent portion to receive the object.

7. The dropping device according to claim 6, further comprising:

a fourth side wall opposite to the third side wall, the height of the fourth side wall being greater than the height of the third side wall.

8. A system comprising:

a dropping device according to claim 2; and a conveying device configured to convey an object from the dropping device; and a filling device comprising:

a filling trough configured to receive an object from the conveying device, the filling trough comprising two movable bottom plates extending downward at a predetermined inclination angle with respect to a horizontal plane along a moving direction of the object; and a second driving assembly configured to move the movable bottom plates in response to receiving a signal indicating that a container reaches below the filling trough, to cause the object to fall into the container through an opening formed by a movement of the bottom plates away from each other.

9. The system according to claim 8, wherein the filling trough further comprises:

an insert plate adapted to be inserted into a cavity of the filling trough so as to block the object after entering the filling trough.

10. The system according to claim 8, wherein the second driving assembly comprises:

a gripper comprising a body defining a chamber and a first piston and a second piston received in the chamber, the first piston and the second piston are configured to move in response to pressure increase and decrease in the chamber, and a first bottom plate of the bottom plates and a second bottom plate of the bottom plates are connected to the first piston and the second piston respectively via a link mechanism.

11. The system according to claim 8, wherein the filling device further comprises:

a sensor located at the lower side of the filling trough and configured to sense the falling of the object to generate a corresponding signal.

12. The system according to claim 8, further comprising:

a conveying line configured to convey the object in a first direction;

a camera configured to monitor the object entering a predetermined area of the conveying line and generate monitoring information; and a robot configured to grasp the object from the conveying line based on the monitoring information, and place the grasped object in each cell on a cell conveyor line;

wherein the cell conveyor line is configured to convey the object in second direction vertical to the first direction.

13. The system according to claim 12, wherein the robot includes a main robot and an auxiliary robot, the auxiliary robot being configured to grasp and place object missed by the main robot into a cell on the cell conveyor line.

14. A filling method comprising:

receiving an object to be filled into a container;

converting a falling posture of the object from a first posture to a second posture by using a dropping device;

wherein the dropping device comprises a movable plate, the movable plate constituting a portion of a second side wall of the dropping device close to a discharging port of the dropping device, wherein converting the falling posture of the object from the first posture to the second posture by using the dropping device comprises:

moving the movable plate at a frequency greater than a frequency of dropping the object;

moving the object converted into the second posture into a filling trough, wherein a bottom plate of the filling trough is movable and extends downward at a predetermined inclination angle with respect to a horizontal plane along a moving direction of the object; and in response to receiving a signal indicating that the container reaches below the filling trough, moving the bottom plate to form an opening at a bottom side of the filling trough, so as to cause the object to fall into the container.

* * * * *